United States Patent [19]

Crosby

[11] 3,989,085

[45] Nov. 2, 1976

[54] METHOD AND APPARATUS FOR LEVELING THE CROSS-DIRECTION PROFILE OF STOCK SLURRY ON A PAPERMACHINE

[75] Inventor: William E. Crosby, Hanahan, S.C.

[73] Assignee: Westvaco Corporation, New York, N.Y.

[22] Filed: June 2, 1975

[21] Appl. No.: 582,863

[52] U.S. Cl. ..... 162/198; 162/208; 162/252; 162/258; 162/263; 162/297; 162/310; 162/DIG. 11

[51] Int. Cl.[2] ..... D21F 1/08

[58] Field of Search ..... 162/198, 208, 212, 252, 162/258, 263, 297, 310, 380, DIG. 6, DIG. 11

[56] References Cited

UNITED STATES PATENTS

| | | | |
|---|---|---|---|
| 1,989,435 | 1/1935 | Wallquist | 162/208 |
| 2,951,007 | 8/1960 | Lippke | 162/198 |
| 3,407,114 | 10/1968 | Springuel | 162/258 X |
| 3,547,775 | 12/1970 | Bossen et al. | 162/198 |
| 3,859,163 | 1/1975 | Haythornthwaite | 162/198 |

*Primary Examiner*—S. Leon Bashore
*Assistant Examiner*—Richard V. Fisher
*Attorney, Agent, or Firm*—W. Allen Marcontell; Richard L. Schmalz

[57] ABSTRACT

Undesirable high concentrations of fiber and moisture in the cross-direction profile of a paper stock slurry laid upon a papermachine fourdrinier screen may be selectively dispersed to level the cross-direction profile by impacting the screen carried pond of slurry at 1.5 to 4 feet down from the headbox slice opening with a fluid spray issued under a pressure drive of from 20 to 100 psi. If a cross-direction high concentration of fiber is to be corrected, the appropriate spray fluid to be used is water. If a cross-direction high concentration of water unaccompanied by a cross-directionally aligned high concentration of fiber is to be corrected, the appropriate spray fluid to be used is air.

18 Claims, 9 Drawing Figures

METHOD AND APPARATUS FOR LEVELING THE CROSS-DIRECTION PROFILE OF STOCK SLURRY ON A PAPERMACHINE

BACKGROUND OF THE INVENTION

1. Field of the Invention

The present invention relates to the art of papermaking. In particular, the present invention describes a method and apparatus for improving the web formation of fourdrinier screen laid paper.

2. Description of The Prior Art

The papermaking process generally comprises a series of drying steps whereby a continuous flow of wood fiber suspended as a dilute aqueous slurry called stock, is consolidated, first, to a wet fibrous mat and finally, to a dry finished paper web.

The fourdrinier papermachine on which this drying sequence is performed comprises first, a wet or forming section followed by a press section and a dryer section. Depending on the product objective, the dryer section may be followed by a calender finishing section.

The forming section of a papermachine comprises a flow receiving vessel for the stock. This vessel, called a headbox, is provided along the bottom thereof with a narrow slit opening called the slice. The slice constitutes the flow regulation device for control of stock flow from the headbox onto a perforate belt called the fourdrinier screen. This screen is driven around a closed belt course which includes a substantially horizontal portion called the table. Stock flow from the slice onto the screen forms a standing pond of stock on the screen along the table. Before the pond is allowed to flow over the lateral edges of the screen, sufficient water is drawn from the stock through the screen by various suction devices located beneath the table. By this action, the fiber, which originally constituted only about 0.5% of the slurry on the dry weight basis, is poured upon the screen as a low viscosity fluid and is removed therefrom at the end of the table as a consolidated fibrous mat.

From the wet end forming section, the fibrous mat is carried into the papermachine press section where additional water is removed mechanically by the squeezing action of a series of low pressure roll nips to form a compacted paper web.

Following the press section, the web is directed into the dryer section comprising a series of heated drums over which the web is threaded. The dryer section removes remaining water from the web evaporatively.

Final caliper and surface finishing of the dry web is achieved in the calender section by a series of high pressure nip rolls.

For purposes of product quality control and machine adjustment, most modern papermachines are equipped with instruments, usually located after the dryer section, to monitor the web characteristics of moisture, basis weight and conditioned weight. Sensors for these instructions continuously reciprocate across the web in the cross-direction (CD) while the web travels longitudinally along the machine-direction (MD) therebeneath. When data from these instruments is visually displayed by a chart recorder or cathode ray tube, a CD profile of the measured characteristics is revealed.

The basis weight characteristic relates to the total mass of web material, water plus fiber per unit of web area; usually per 1000 ft.$^2$ or per ream (3000 ft.$^2$). Since the moisture content of the web is measured independently of the basis weight, these two characteristic values may be combined to derive the characteristic of conditioned weight which is the measure of fiber quantity, exclusive of water, present in the web per unit of area.

It is the objective of every papermaker to achieve a uniform distribution of conditioned weight and moisture throughout the web in both, the CD and MD directions thereof. However, the mechanics of variations in these characteristics are different with respect to the CD and MD directions.

In the MD direction, conditioned weight variations are predominantly due to random occurrences of fiber floccing: in other words, uncontrolled consolidation of fiber groups occurring in the headbox or before. Poor fiber distribution due to floccing is manifested in the finished sheet by a mottled or splotchy appearance.

Conditioned weight variations that are stable as to magnitude and CD location, on the other hand, are predominately the result of CD variations in the headbox slice opening. This paper web defect is seen in the finished product as light and dark streaks of web density.

CD moisture variations that are stable as to magnitude and CD location are normally an additional consequence of an improperly adjusted slice opening. Under such circumstances, a stable, high moisture region in the CD moisture profile is also attended by correspondingly high basis weight and conditioned weight profiles. However, on occasion, a stable high moisture region in the CD profile will not be attended by a conditioned weight concentration. This is a circumstance more apt to be caused by turbulence and flow characteristics internal of the headbox. Accordingly, the condition may not be readily affected by manipulation of the slice opening.

It would seem that a zone in the finished paper web that is uniform as to conditioned weight would be acceptable notwithstanding moisture variations. However, localized moisture variations affect the dimensional stability of the finished web and for this reason, all increments of the web must be dried to a threshold minimum moisture content. Consequently, if the web is burdened with a narrow, high moisture zone along the center thereof, the lateral remainder of the web must be over-dried in order to drive the high moisture zone below the threshold minimum. The over-all result of these circumstances is an inefficient expenditure and waste of thermal energy in the papermachine dryer section on 90% of the web area, for example, to dry 10% of the web to tolerance.

From the perspective of moisture concentrations unattended by conditioned weight concentrations it would also be of great value to a papermachine operator to selectively adjust the moisture distribution in the web prior to the dryer section but independently of the fiber distribution.

U.S. Pat. No. 3,407,114 discloses a prior art technique for correcting a poor CD fiber distribution condition whereas U.S. Pat. No. 2,951,007 discloses a technique of selectively adding water to a predominantly finished web having a poor CD moisture distribution condition.

SUMMARY OF THE INVENTION

It is, therefore, an object of the present invention to disclose a method and apparatus for selectively redistributing fiber and water, each independently of the other, on a screen laid stock pond to approach a level CD profile of the respective characteristics.

This objective and others to be subsequently made apparent, may be achieved by directing selectively positioned fan sprays of fluid into the pond approximately 1.5 to 4 feet down from the slice.

Moisture and conditioned weight CD profile monitoring instruments are used to precisely locate, on the papermachine, the CD coordinate of excessively high concentration zones of conditioned weight and moisture.

If the characteristic to be corrected is conditioned weight, the fluid used for spray into the pond should be water.

If the characteristic to be corrected is moisture at a CD coordinate where conditioned weight is satisfactory, the fluid to be sprayed into the pond should be air.

Apparatus necessary to practice the present invention may range from a manually interpreted cathode ray tube display of the appropriate web characteristic CD profile and a manually positioned portable spray apparatus to an automatic digital data processingg system for interpreting the characteristic profile and actuating selectively identified values in fixed fluid distribution system.

BRIEF DESCRIPTION OF THE DRAWING

Relative to the drawing wherein like reference characters designate like or similar elements.

DESCRIPTION OF THE PREFERRED EMBODIMENTS

Figure 1:
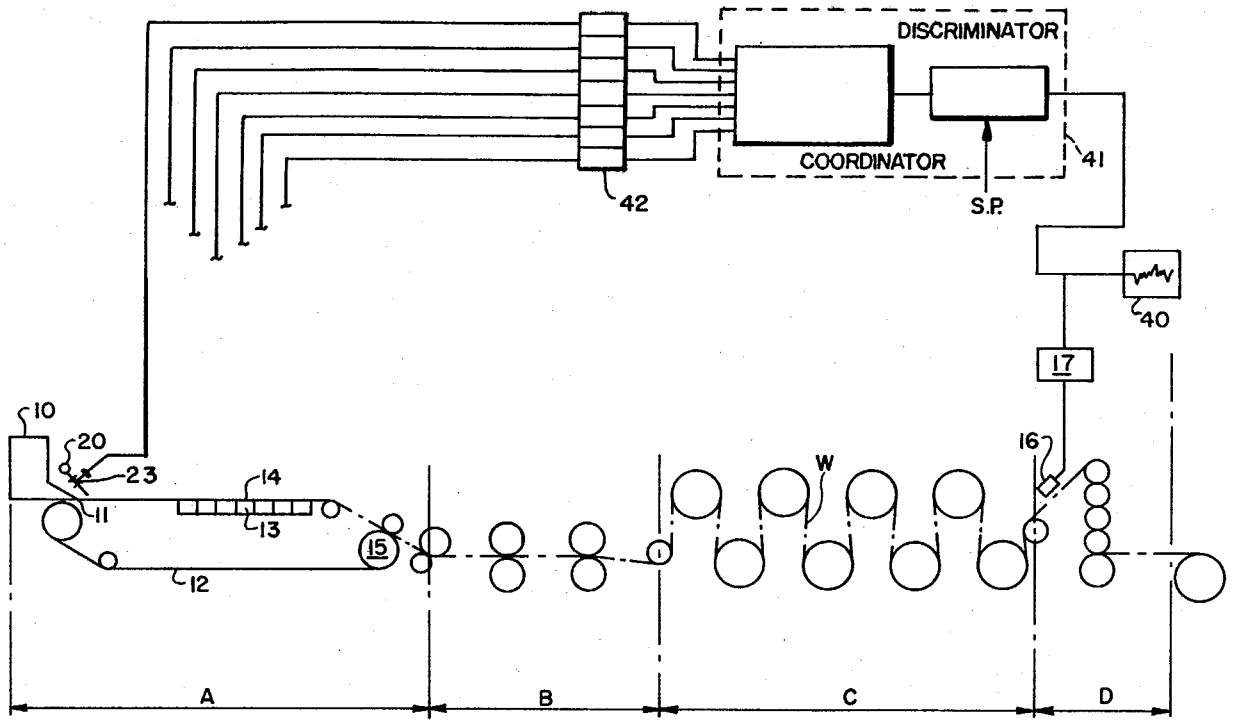
FIG. 1 illustrates a profile schematic of a fourdrinier papermachine.

For purposes of orientation, FIG. 1 schematically illustrates a typical fourdrinier papermachine comprising a wet formation section A, a wet press section B, a dryer section C and a calender section D.

The wet formation section A comprises a headbox 10 having a slice opening 11 located at the headbox bottom above the fourdrinier screen 12. A series of suction boxes 13 are spaced along the screen table 14 between the slice 11 and the couch roll 15.

Figure 2:
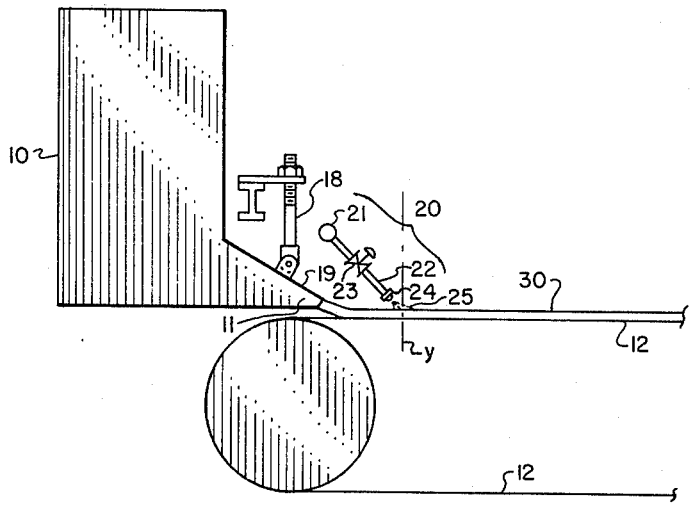
FIG. 2 illustrates an enlarged schematic of the headbox end of a papermachine.

A more detailed view of the headbox end of the wet formation section A is shown by FIG. 2 which additionally illustrates a typical slice screw 18 arrangement whereby the CD profile of the stock pond 30, as laid upon the screen 12, is conventionally regulated. A multiplicity of slice lip adjusting screws 18 are secured to the slice lip 19 at equally spaced locations therealong.

Figure 3:
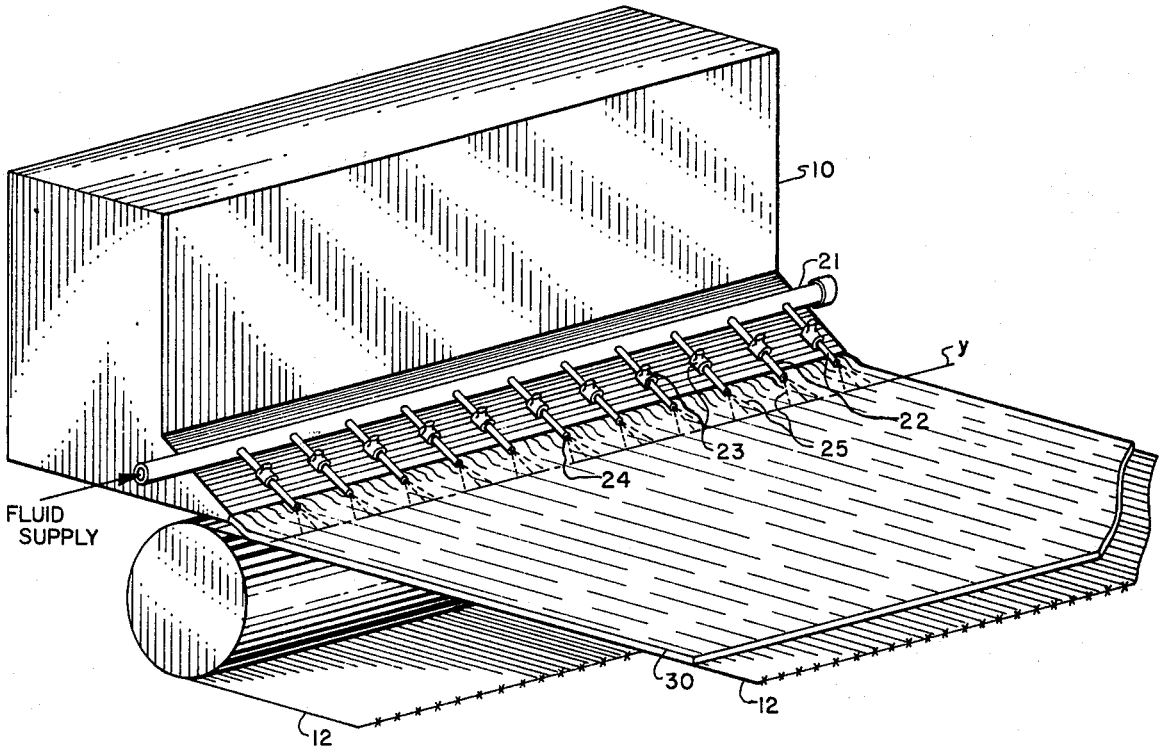
FIG. 3 is an isometric illustration of the headbox end of a papermachine including the fluid distribution manifold and spray heads of the present invention.

Also illustrated by FIGS. 2 and 3 is apparatus 20, particular to the present invention, comprising a fluid manifold 21 having a plurality of equally spaced extensions 22 depending therefrom. Each extension 22 is provided with a fan spray nozzle 24 and a valve 23.

The apparatus 20 is positioned relative to an intersection of a vertical plane Y with the surface plane of pond 30 whereby the fluid spray 25 will impact the pond 30 surface along such line of intersection.

Plane Y is positioned approximately 1.5 to 4 feet down the table 14 from the slice 11.

The exact height of nozzles 24 above the pond surface will depend upon the spread pattern selected for the sprays 25 and will be coordinated with the lateral spacing between nozzles 24 whereby the fluid curtains 25 from adjacent sprays will coincide along the intersection line of plane Y with no more than one-half inch overlap.

As a specific example, in combination with a fourdrinier papermachine carrying a web basis weight target of 33 pounds per ream at a screen speed of 1335 f.p.m., a manifold 21 of one and one-half inch nominal diameter supplied eight pipe extensions 22, each extension being of one-quarter inch nominal pipe size. The extensions 22 were laterally separated, each from the other, along the manifold by six inches between centers. The spray heads 24 had a capacity of 2.0 g.p.m. at 20 psi and a discharge angle of 90°. As indicated by FIGS. 2 and 3, the spray pattern was directed downstream along the MD at an angle of approximately 45° with the table 14 plane.

Characteristic of most manifold distribution systems, the pressure drive against the sprays 25 will vary relative to the supply source pressure and the discharge flow rate from the manifold 21. However, satisfactory results have been achieved with water sprays from the described apparatus over a broad pressure range of 20 of 100 psi as measured within the extensions 22.

Similarly, satisfactory results have been achieved from the spray of air over a pressure range of 20 to 100 psi as measured within the extensions 22.

For web quality control monitoring, sensors 16 may be mounted adjacent the web path following the dryer section C (see FIG. 1). Such sensors 16 are usually mounted for continuous, reciprocating movement across the web CD to develop a CD profile of the measured characteristics.

Electrical signals from the sensors 16 may be merely amplified and visually displayed as by a cathode ray tube or recorder 40 for manual interpretation.

If control functions are to be derived from the sensor 16 signal data, it is often more convenient to digitalize this data as by an analog-to-digital converter 17.

The solid line curve off the FIGS. 4 through 9 graphs is illustrative of typical displays received from sensors 16. The abscissa for each of these graphs relates to a linear CD machine position. The magnitude of a measured web characteristic is plotted along the graph ordinate respective to a particular CD machine position (station). Accordingly, the graphs represent a CD profile of the respective characteristics.

Figure 4:
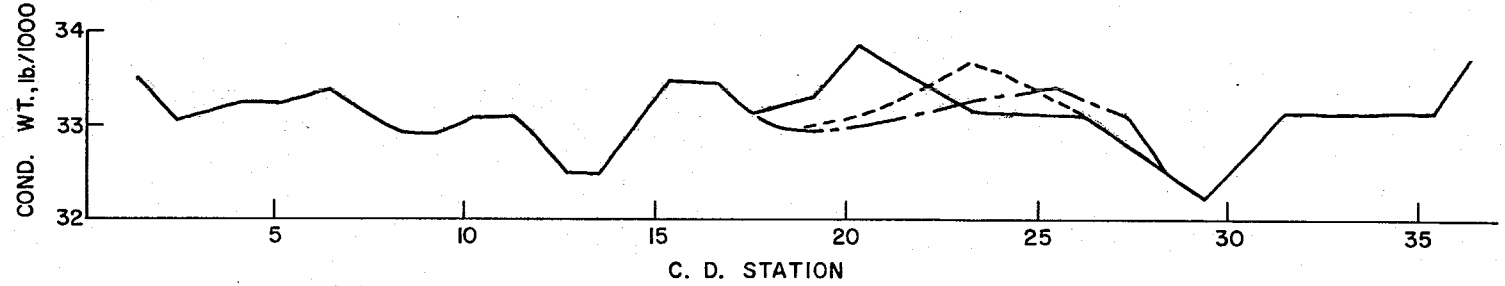
FIGS. 4 and 7 are graphs of the cross-directional profile of a paper web conditioned weight plotted against cross-directional machine stations.
Figure 9:
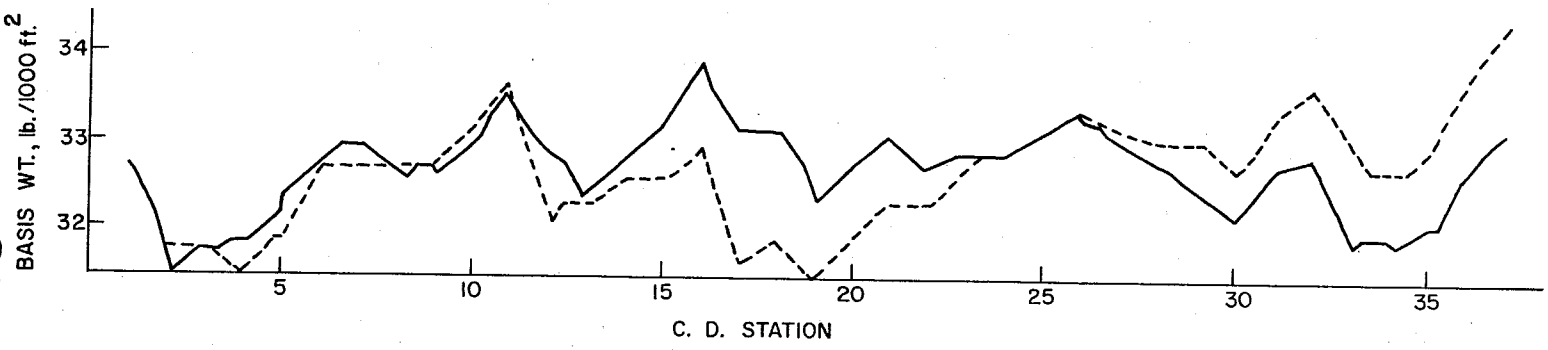
Figure 8:
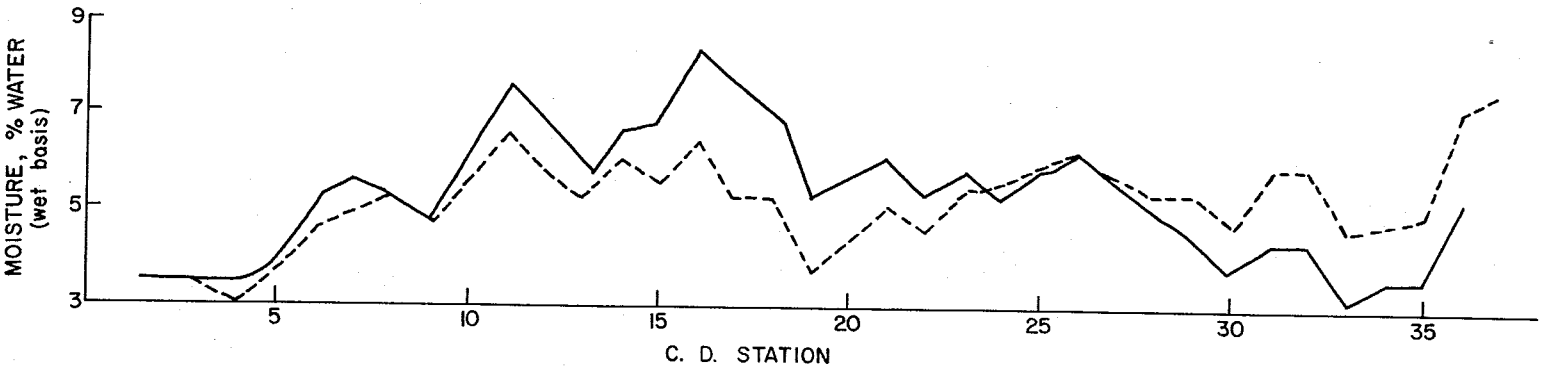
Figure 7:
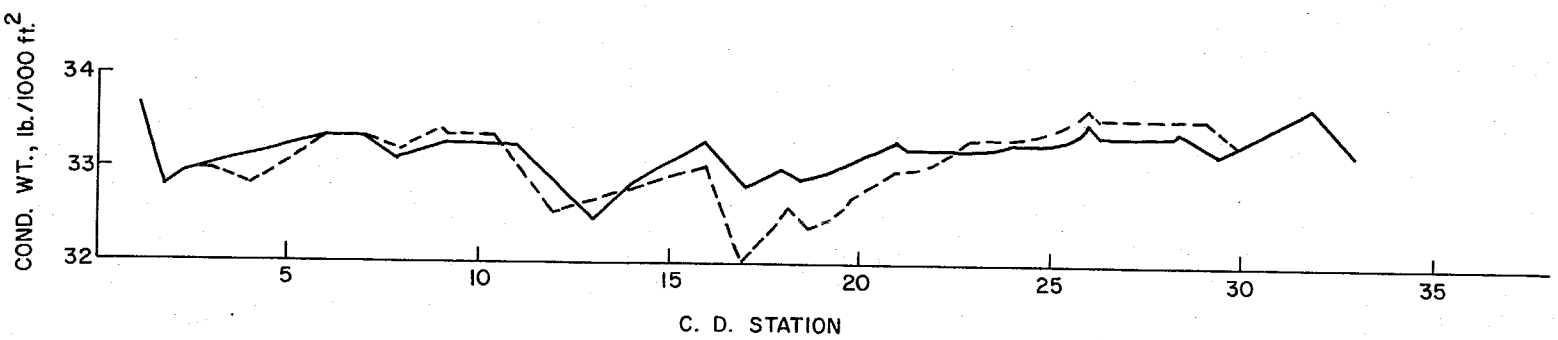

Noting the solid line curve of FIG. 4, in particular, a high concentration of fiber between CD stations 17 and 23 is represented. This region of high fiber concentration is flanked by regions of proportionately low fiber concentration. Since this curve is relatively time stable and is accompanied by a correspondingly high moisture profile (FIG. 5) and basis weight profile (FIG. 6), it is presumed that the cause of the high fiber concentration condition originates from a defect in slice lip 11 profile. However, consider that the solid line curve of FIG. 4 represents the best profile that may be achieved by manual manipulation of the slice lip adjusting screws 18. This condition gives rise to one utility facet of the present invention.

In the present case example, sprays of the aforedescribed construction were directed into the pond 30 between the CD stations 19 and 20. It will be seen from the FIG. 4 dotted line curve that the fiber concentration peak was consequently shifted laterally from a maximum at CD station 20 to a maximum at CD station 23. However, the peak amplitude was reduced.

The dashed and dotted line graph of FIG. 4 illustrates the comparative effect of applying sprays to the same stock formation between the CD stations 20 and 23. In this case, the conditioned weight concentration was substantially eliminated with the fiber therefrom contributing to a partial filling of the low concentration zone centered at CD station 29.

Figure 6:
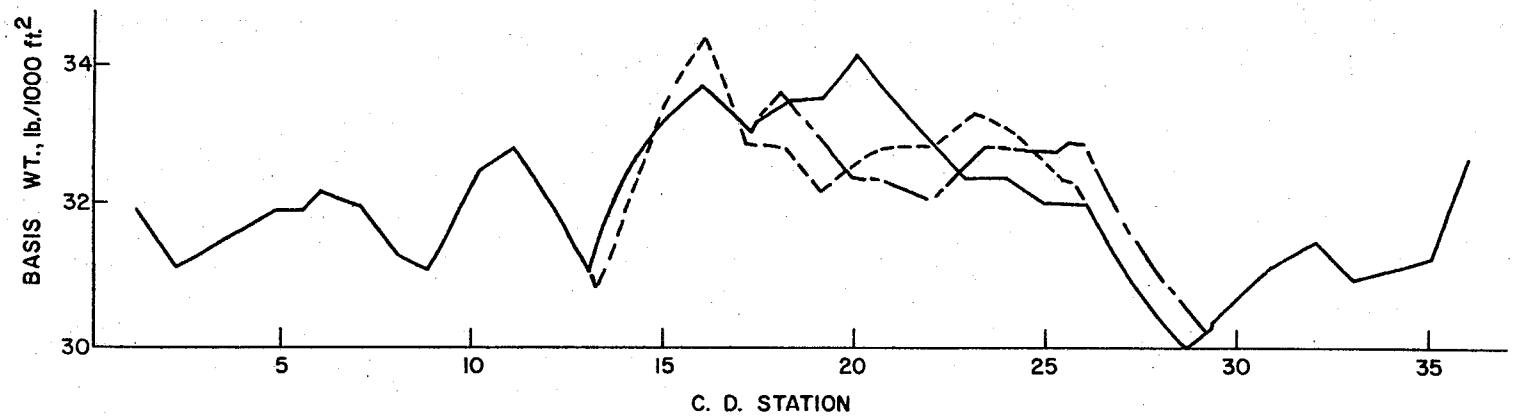
FIGS. 6 and 9 are graphs of the cross-directional profile of paper web basis weight plotted against cross-directional machine direction.
Figure 5:
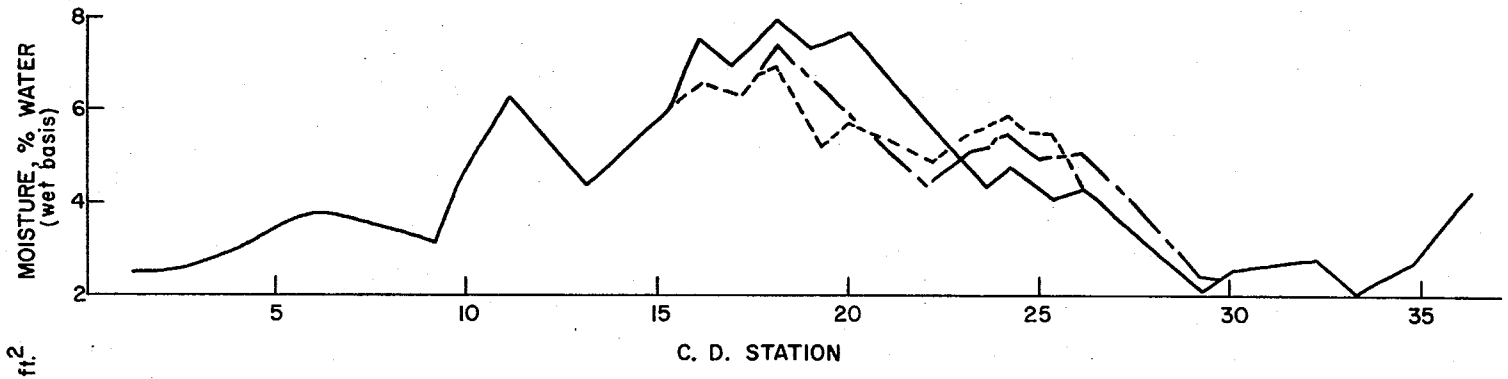
FIGS. 5 and 8 are graphs of the cross-directional profile of paper web moisture content plotted against cross-directional machine stations.

The comparative graphs of FIGS. 5 and 6 are companions to those of FIG. 4 and illustrate the consequent effect of the invention on the characteristics of final moisture and basis weight. Of particular note is the effect of the invention, as used to correct conditioned weight, on moisture. Since additional water is being injected into a localized region of the pond by the sprays 25, it would be expected that moisture would increase along that region. However, this result does not occur since the additional water is also removed from the pond 30 before reaching the couch 15 thereby leaving the redistributed fibers more efficiently responsive to the subsequent drying processes.

In view of the aforedescribed cause and effect relationship, it would appear that the water sprays 25 are locally diluting and dispensing the fiber concentration along the troublesome region. Since the stock is still a fluid of very low consistency at the spray impact point of 1.5 to 4 feet down the table 14 from the slice 11, it is quite compliant to the impact disturbance and no web deterioration of streaking is found to result.

There is some question, however, as to whether the operative mechanics of the invention are simply dilution and dispersion. This question arises relative to the circumstance illustrated by the curves of FIGS. 7 and 9. Relative to FIG. 8, a high moisture zone, centered at CD station 16, extends from CD station 13 to 19. Over the same CD zone, FIG. 7 reveals a normal or desirable conditioned weight concentration. When the high moisture zone is treated with the apparatus 20 supplying air, the high concentration of moisture is reduced but without an unreasonable further reduction in conditioned weight as represented by the dotted line curve of FIGS. 7, 8 and 9. If the mechanics of the invention were simply dispersion, it would seem that fiber would be carried with the water under the impact of an air spray 25. For this reason and because of the relatively strong impact and penetration a 20 to 100 psi spray stream has upon the pond 30, it is suggested that the fluids, water and air, may merely be appropriate mediums for a localized standing wave disturbance, the molecular activity of the stock within the standing wave being the true vehicle of dispersion.

The instrumentation 17 for scanning the web W and obtaining a CD profile of conditional weight or moisture characteristics as displayed by a chart recorder or cathode ray screen 40, for example, is necessary to the present invention for the purpose of cross-directionally locating those regions of undesirably great concentrations of fiber or water.

Also necessary to the present invention is fluid spray apparatus having performance characteristics such as those described relative to apparatus 20, although not necessarily as elaborate as that illustrated by FIGS. 2 and 3.

In a very basic sense, the present invention may be practiced by manually locating the CD position of troublesome fiber or moisture concentration and directing the fluid impulse from a portable fluid spray apparatus into the fluidized stock pond 30 in the corresponding CD position at about 1.5 to 4 feet down from the slice 11.

On a more elaborate scale, the invention may be more conveniently practiced manually by a permanent manifold installation having spray extensions 22 distributed across the entire deckle width of the headbox 10. As in the basic example, a manual correlation from the CD profile display 40 is required to locate the CD position of a troublesome region. Once located, however, it is merely necessary to manually open the appropriate valves 23.

The schematic of FIG. 1 illustrates a fully automatic embodiment of the invention wherein the fixed position valves 23 of FIGS. 2 and 3 are remotely actuated by individual signals emanating from a valve operator 42. Pursuant to this fully automatic system, digital signals from the analog-to-digital converter 17 are received by discriminating circuitry within a computer device 41 well known to the automatic data processing arts which compares the magnitude of a digital ordinate signal to a prescribed set-point. In the present case, if ordinate signals exceed the set-point S.P. over an abscissa continuum which also exceeds a prescribed set-point, coordinating circuitry, also with the computer 41, will identify and isolate those valves 23 aligned with CD stations corresponding with the selected abscissa continuum. Consequently, appropriate signals will be issued to valve operator 42 to actuate the identified valves 23. Such actuation may take the form of electric or pneumatic motor power, for example, to the respective valves.

Having fully described my invention, certain modifications and substitutions thereto will become obvious to those of ordinary skill in the art. Such obvious modifications and substitutions are to be encompassed within the scope of my appended claims wherein, for my invention,

I claim:

1. A process for leveling the cross-directional distribution of a paper stock constituent deposited continuously within a dilute aqueous slurry upon a machine-direction traveling foraminous screen as the first of several water removal steps in a paper web forming sequence, said constituent leveling process comprising the steps of:

A. Flowing an elongated stream of the slurry from a headbox slice opening onto the traveling screen to form a fluidized pond of said slurry on said screen;

B. Sensing a cross-directional concentration profile of said stock constituent within a paper web consolidated from said slurry;

C. Identifying from said profile, the cross-directional location of substantially stable, machine-direction extending regions of undesirably great concentrations of said stock constituent; and, D. Impacting said fluidized pond with a cross-directionally elongated spray of fluid that is cross-directionally aligned with said regions of great constituent concentration, said spray impacting said pond at a location of substantially 1.5 to 4 feet along the machine-direction from said slice opening to laterally disperse said great constituent concentration.

2. A process as described by claim 1 wherein said spray of fluid is issued under a pressure drive of approximately 20 psi or greater.

3. A process as described by claim 1 wherein said constituent is water and said spray fluid is air.

4. An apparatus for leveling the cross-directional distribution of a paper stock constituent deposited continuously within a dilute aqueous slurry upon a machine-direction traveling foraminous screen as the first of several water removal steps in a paper web forming sequence, said constituent leveling apparatus comprising:

A. A papermachine headbox containing said dilute aqueous slurry of stock and having a cross-directionally elongated slice opening adjacent said traveling screen for depositing a fluidized pond of said stock slurry thereon;

B. Sensing means for detecting the cross-directional concentration profile of a single stock constituent within a continuously forming paper web consolidated from said stock slurry; and, C. Fluid spray means positioned adjacent said headbox and cross-directionally aligned with substantially stable, machine-direction extending regions of undesirably great concentrations of said single stock constituent for emitting a cross-directionally elongated spray of fluid against said pond for impact at a location of substantially 1.5 to 4 feet along the machine-direction from said slice opening to laterally disperse said machine-direction extending regions of great constituent concentration.

5. Apparatus as described by claim 4 comprising means to supply fluid to said spray means at a pressure drive of substantially 20 psi or greater.

6. Apparatus as described by claim 4 wherein said sensing means comprises means for detecting the cross-directional concentration of water and said fluid spray means emits an elongated spray of air.

7. Apparatus as described by claim 5 wherein said sensing means comprises sensor elements mounted adjacent said consolidated paper web for continuous cross-directional reciprocation thereacross, said sensor elements emitting electrical signals proportional to the concentration magnitude of said stock constituent as related to a discrete cross-directional position, said fluid spray means comprising a fluid manifold having a plurality of fluid distribution conduits extending therefrom, each of said conduits having a remote actuated, fluid flow interrupting valve means therein, said apparatus further comprising discriminating means for identifying sensor element signals connoting a concentration magnitude of said stock constituent in excess of a predetermined set-point, coordinating means for identifying particular ones of said valve means being cross-directionally aligned with regions of said stock constituent concentration magnitude exceeding said set-point, and actuating means for actuating said particular ones of said valve means to emit said fluid sprays therefrom.

8. A process for leveling the cross-directional distribution of fiber deposited continuously as a dilute aqueous slurry upon a machine-direction traveling foraminous screen as the first of several water removal steps in a paper web forming sequence, said fiber leveling process comprising the steps of:

A. Flowing an elongated stream of the slurry from a headbox slice opening onto the moving screen to form a fluidized pond of said slurry on said screen;

B. Sensing a cross-directional profile of fiber concentration magnitude within a paper web consolidated from said slurry;

C. Identifying from said profile, the cross-directional location of substantially stable, machine-direction extending regions of undesirably great fiber concentration; and, D. Impacting the top surface of said fluidized pond with a cross-directionally elongated water spray that is cross-directionally aligned with said regions of great fiber concentration, said spray impacting said pond at a location of substantially 1.5 to 4 feet along the machine-direction from said slice opening to laterally disperse said fiber concentration.

9. A process as described by claim 8 wherein the hydraulic pressure against said water spray is approximately 20 psi or greater.

10. An apparatus for leveling the cross-directional distribution of fiber deposited continuously as a dilute aqueous slurry upon a machine-direction traveling foraminous screen as the first of several water removal steps in a paper web forming sequence, said leveling apparatus comprising:

A. A papermachine headbox containing said dilute aqueous slurry of fiber and having a cross-directionally elongated slice opening adjacent said traveling screen for depositing a fluidized pond of said slurry thereon, B. Fiber concentration sensing means for detecting a cross-directional profile of fiber concentration magnitude within a continuously forming paper web consolidated from said aqueous slurry; and, C. Water spray means positioned adjacent said headbox and cross-directionally aligned with substantially stable, machine-direction extending regions of undesirably great fiber concentration for emitting a cross-directionally elongated spray of water against said pond for impact at a location of substantially 1.5 to 4 feet along the machine-direction from said slice opening to laterally disperse said machine-direction extending regions of great fiber concentration.

11. Apparatus as described by claim 10 comprising means to supply water to said spray means at a hydraulic pressure of approximately 20 psi or greater.

12. Apparatus as described by claim 10 wherein said water spray means comprises a cross-directionally extending fluid manifold positioned above said traveling screen, said manifold having a plurality of uniformly spaced distribution conduits extending therefrom, each of said conduits having a fan spray orifice disposed on the distal end thereof and valve means within said conduit between said orifice and said manifold.

13. Apparatus as described by claim 12 wherein said valve means are remotely actuated, said concentration sensing means comprising magnitude discriminating means for identifying said machine-direction extending regions of great fiber concentration and coordinating means for actuating respective ones of said valve means in cross-directional alignment with identified regions of great concentration.

14. A process for leveling the cross-directional distribution of water within an aqueous slurry of paper stock deposited continuously upon a machine-direction traveling foraminous screen as the first of several water removal steps in a paper web forming sequence, said water leveling processes comprising the steps of:

A. Flowing an elongated stream of the slurry from a headbox slice opening onto the traveling screen to form a fluidized pond of said stock on said screen;

B. Sensing cross-directional water and fiber concentration profiles within a paper web consolidated from said slurry;

C. Identifying from said profile, the cross-directional location of substantially stable, machine direction extending regions of undesirably great concentrations of water attended by cross-directionally aligned regions of substantially stable, machine direction extending regions of desirable concentrations of fiber; and, D. Impacting said fluidized pond with a cross-directionally elongated spray of air that is cross-directionally aligned with said water and fiber concentration regions, said air spray impacting said pond at a location of substantially 1.5 to 4 feet along the machine-direction from said slice opening to laterally disperse said water concentration.

15. A process as described by claim 14 wherein the pressure drive against said air spray is approximately 20 psi or greater.

16. An apparatus for leveling the cross-directional distribution of water in a paper stock deposited continuously as a dilute aqueous slurry upon a machine-direction traveling foraminous screen as the first of several water removal steps in a paper web forming sequence, said water leveling apparatus comprising:

A. A papermachine headbox containing said aqueous slurry of stock and having a cross-directionally elongated slice opening adjacent said traveling screen for depositing a fluidized pond of said stock slurry thereon:

B. Sensing means for detecting the cross-directional concentration profile of water and fiber, respectively, within a continuously forming paper web consolidated from said stock slurry; and, C. Air spray means positioned adjacent said headbox and cross-directionally aligned with substantially stable, machine-direction extending regions of undesirably great concentrations of water attended by cross-directionally aligned regions of substantially stable, machine-direction extending regions of desirable concentrations of fiber for emitting a cross-directionally elongated spray of air against said pond for impact at a location of substantially 1.5 to 4 feet along the machine-direction from said slice opening to laterally disperse said water concentration.

17. Apparatus as described by claim 16 comprising means to supply air to said spray means at a pressure drive of substantially 20 psi or greater.

18. Apparatus as described by claim 18 wherein said sensing means comprises sensor elements mounted adjacent said consolidated paper web for continuous cross-directional reciprocation thereacross, said sensor elements emitting electrical signals proportional to the concentration magnitude of water and air, respectively, as related to a discrete cross-directional position, said air spray means comprising a cross-directionally extending fluid manifold positioned above said traveling screen, said manifold having a plurality of uniformly spaced distribution conduits extending therefrom, each of said distribution conduits having a remote actuated, fluid flow interrupting valve means therein, said apparatus further comprising discriminating means for identifying respective sensor element signals connoting water and fluid concentration magnitudes in excess of respective set-points, coordinating means for identifying particular ones of said valve means being cross-directionally aligned with regions of water concentration magnitude exceeding the water concentration set-point attended by cross-directionally aligned regions of fiber concentration not exceeding the fiber concentration set-point, and actuating means for actuating said particular ones of said valve means to emit said air sprays therefrom.

* * * * *

UNITED STATES PATENT OFFICE

CERTIFICATE OF CORRECTION

Patent No. 3,989,085 Dated November 2, 1976

Inventor(s) William E. Crosby

It is certified that error appears in the above-identified patent and that said Letters Patent are hereby corrected as shown below:

Column 1, line 15, following "stock" delete --,--; line 59, "instructions" should be --instruments--. Column 3, line 24, "values" should be --valves--. Column 4, line 51, "off" should be --of--. Column 7, line 43 (Claim 7, line 1), "claim 5" should be --claim 4--.

Column 10, line 16 (Claim 18, line 1), "claim 18" should be --claim 16--; line 31 (Claim 18, line 16), "fluid" should be --fiber--.

Signed and Sealed this

First Day of February 1977

[SEAL]

*Attest:*

RUTH C. MASON
*Attesting Officer*

C. MARSHALL DANN
*Commissioner of Patents and Trademarks*